United States Patent [19]

Amato

[11] 4,090,711

[45] May 23, 1978

[54] GOLF CLUB SHAFTS INCLUDING VIBRATORY MEANS

[76] Inventor: Raymond G. Amato, 28 Ash Ter., Parlin, N.J. 08859

[21] Appl. No.: 677,315

[22] Filed: Apr. 15, 1976

[51] Int. Cl.[2] ..... A63B 53/12

[52] U.S. Cl. ..... 273/80 R

[58] Field of Search ..... 273/67 R, 67 DA, 68, 273/72 A, 73 R, 73 C, 80 R, 80 B, 81 R, 162 R, 183 R, 183 B, 186 R, 186 A, 193 R, 194 R, 73 H, 73 J; 145/61 M; 188/1 B; 64/1 V; 280/11.37 B, 11.37 D

[56] References Cited

U.S. PATENT DOCUMENTS

| | | | |
|---|---|---|---|
| 1,526,734 | 2/1925 | Andrews et al. | 273/73 J X |
| 2,023,131 | 12/1935 | Gibson | 273/80 B |
| 2,051,083 | 8/1936 | Hart | 273/81 A |
| 2,823,037 | 2/1958 | LaFerte | 273/186 A |
| 3,059,727 | 10/1962 | Fuchs | 188/1 B |
| 3,075,406 | 1/1963 | Butler et al. | 64/1 V X |
| 3,318,602 | 5/1967 | Kunihisa | 273/162 R |
| 3,941,380 | 3/1976 | Lacoste | 273/72 A |

FOREIGN PATENT DOCUMENTS

| | | | |
|---|---|---|---|
| 726,578 | 1/1966 | Canada | 273/81 A |
| 26,055 | 11/1968 | Japan | 273/80 R |

*Primary Examiner*—Richard J. Apley
*Attorney, Agent, or Firm*—Arthur L. Plevy

[57] ABSTRACT

There is disclosed a vibratory apparatus for use in conjunction with a golf club and located within the hollow confines of a tubular shaft portion of said club. The apparatus comprises first and second disks rigidly secured within the hollow of said club and spaced one above the other and a vibratory flexible member coupled to said disks and located within said hollow relatively central thereto; said flexible member adapted to vibrate when the club head contacts the golf ball to impart a vibratory sensation to the user of said club.

5 Claims, 5 Drawing Figures

GOLF CLUB SHAFTS INCLUDING VIBRATORY MEANS

BACKGROUND OF THE INVENTION

This invention relates to golf clubs in general and more particularly to vibratory apparatus included within the hollow of the shaft of a golf club.

There are a number of patents in the prior art which relate to improved golf clubs or devices which enable a golfer to practice his swing or improve his game.

Many devices depicted in the prior art are practice devices and are not made to be used when playing the game of golf. Thus, such devices involve relatively complicated clubs which cannot be used to play the game of golf.

Examples of such devices are shown by referring to U.S. Pat. No. 3,215,437 by Webb entitled GOLF PRACTICE CLUB INCLUDING INERTIA CONTROL INDICATOR MEANS, U.S. Pat. No. 3,498,616 entitled GOLF SWING PRACTICE DEVICE issued, on Mar. 3, 1975 to R. D. Hurst and others as U.S. Pat. No. 3,317,211.

Other patents such as U.S. Pat. No. 3,318,602 entitled GOLF CLUB HAVING A HANDLE WITH VIBRATION SENSING MEANS issued on May 9, 1967 to R. R. Kunihisa show a golf club which appears as an ordinary golf club, but which is an illegal device, as it does not conform to the rules governing the game of golf. The device depicted in that patent employs a vibrating rod which is coupled to an aperture to give a golfer a feel of distance. Such clubs are not proper according to U.S.G.A. Rules.

In any event, due to the progress made in material engineering and due to the extensive amount of design and engineering efforts expended by the manufacturers of golf clubs, there has been a great deal of work in formulating and fabricating shafts for such clubs. These shafts have been designed in an effort to improve their function, quality, feel and accuracy in order to accommodate differences in a golfer's swing. Thus, one can purchase golf clubs wherein shafts are fabricated from carbon steel, aluminum and graphite and other materials as well.

It certainly has been determined that the type of shaft used will affect the golfer's game. Thus, if a golfer uses a shaft that is too flexible for his swing, it will, in general, cause him great inconvenience which will result in timing problems and inaccurate shots. Thus, for this golfer who may have a fast swing, such a shaft would not be suitable.

It is therefore apparent that there is a desired proper shaft and flex for each golfer which would enhance the timing of his swing and enable him to participate and experience more accurate shots.

Certain shafts for example, are very stiff, but should be used by certain golfers who do not use a stiff shaft because of custom and habit. This invention, therefore, resides in apparatus which is mounted internal to a shaft as confined within the hollow of the shaft. The apparatus is adapted to improve the feel of the shaft only when the club contacts the ball. The apparatus functions to vibrate upon impact to give the user a softer feel when he contacts the ball.

Essentially, the apparatus functions to enable the golfer to "feel" the club during contact with the ball so that he may control his tempo and swing according to the feel imparted by this apparatus. The apparatus is designed such that it will not affect the main function of the particular type of shaft as the manufacturer designed it. The apparatus is also light in weight and can be incorporated into golf clubs during the manufacturing process in a simple and economical way. Due to the nature of the apparatus, the appearance of the golf club remains the same and the club can be used to play the game of golf without violating any of the rules concerning club structure.

BRIEF DESCRIPTION OF PREFERRED EMBODIMENT

A golf club of the type comprising a golf club head, a tubular shaft having at least a hollow portion, said shaft coupled to said head at one end and handle means located on said shaft at said other end, in combinations therewith of apparatus for providing a vibratory effect when said club head strikes a golf ball, comprising first and second disk members rigidly secured within said hollow of said shaft and positioned one above the other at a distance along the length of said shaft, and a flexible vibratory member coupled between said first and second disk members and located within said hollow relatively central thereto, said member adapted to vibrate when said club head strikes said ball due to the impact of said club head with said ball to impart to a vibratory feel to the hands of a user of said club during said impact.

DETAILED DESCRIPTION OF FIGURES

Figure 1:
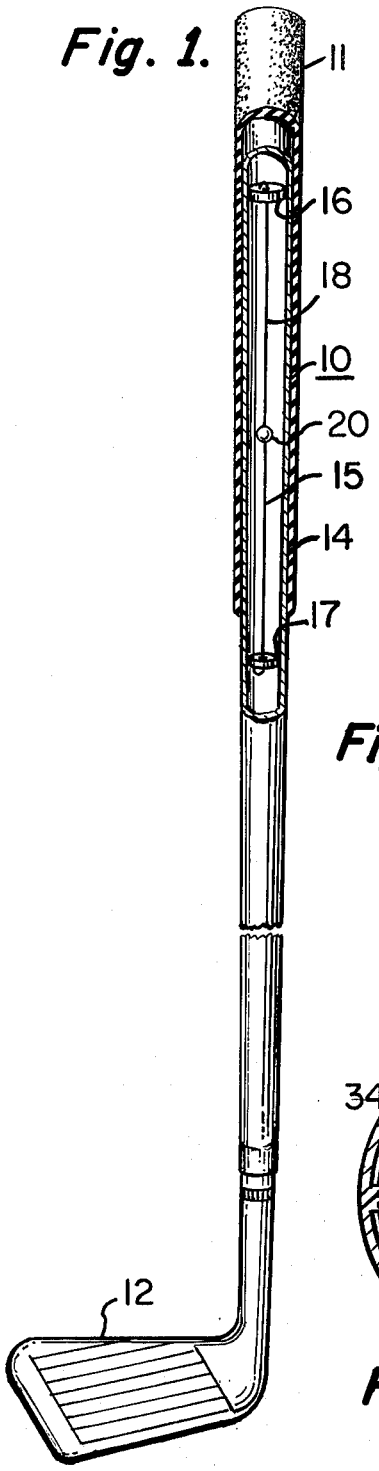
FIG. 1 is a plan view of a golf club having a partial cross section for depicting the apparatus according to the invention.

FIG. 1 shows a typical golf club 10 which is conventional in appearance and may be, for example, a wood, iron or a putter.

At the onset, it is understood that the mechanism to be described can be used in conjunction with any type of golf club and hence, any type of shaft.

Basically, the club 10 includes a golf club head 12 which has a shape according to the type of club used. Hence, the shape of the head 12 will differ for different numbered irons, woods and so on. The head is coupled to a longitudinal tubular shaft section 14, which includes a hollow portion 15 usually closest to the handle end 11 of the club 10. The hollow portion 15, in any event, appears in most modern clubs, whether they be fabricated from steel, aluminum, graphite or some other material.

Located within the hollow portion 15 of the club 10 are first and second disk-like members 16 and 17. The members 16 and 17 are shown relatively as cylindrical disks but may be of any geometrical configuration such as spheres, cubes and so on. In any event, the disks 16 and 17 are positioned one above the other within the hollow confines of the shaft. The shaft section 14 of a golf club normally tapers from the handle end 11 to the club head 12 and hence, disk 17 may be slightly smaller than disk 16.

The disks 16 and 17 are spaced apart as shown along the length of the shaft and may be located as shown, or disk 16 may be located upwards or closer to the handle section of the club 10. The disks may be spaced apart anywheres from a few inches to a foot or more, depending upon the type of effect that a user might desire.

The disks are rigidly secured within the hollow confines of the shaft by means of a strong bonding agent, such as an epoxy or glue; or as will be explained, may be mechanically secured thereto.

The disks 16 and 17 may also be force fitted within the hollow of the shaft due to the tapering of the shaft.

Located relatively centrally and between the disks is shown a wire or flexible member 18. The member 18 may be fabricated from a flexible metal or plastic and as positioned, is centrally located within the hollow. The ends of member 18 are rigidly coupled to the disks 16 and 17. There are numerous ways of accomplishing this. One way as shown in FIG. 1, is that each disk 16 and 17 may have a central aperture. The ends of the wire 18 are directed through the aperture and are hooked, bent or otherwise deformed as shown to therefore assure support of the wire between the disks 16 and 17.

Also shown located on the wire, is a small weight 20. The weight 20 may be included to offer further advantages; but as will be seen, the wire 17 without the weight will be sufficient for many purposes.

The weight 20 may be fabricated from a metal material such as lead and secured to the wire in a similar manner as a sinker is secured to a fishing line.

The wire 18, as positioned between the disks and due to its central location, can vibrate within the hollow without contacting the inside walls of the shaft. The tautness of the wire will determine the frequency and intensity of the vibration and can be adjusted accordingly.

The operation of the device is as follows:

When a golfer uses the club, he cannot ascertain any differences between this club and any other typical golf club. When he strikes the golf ball, the wire 18 vibrates. The vibration is imparted and coupled to the shaft and the handle. This occurs at impact only and basically, the vibration of the wire will set off a vibration effect to the grip end that will create a softer and more flexible feel to the hands of the user. Thus enabling a golfer to groove his swing while acheiving maximum distance and accuracy.

Perhaps the best way to describe the effect would be inherent in the slang expression, as a "boing" effect. This can be felt on the most delicate of shots which would include a putt or a chip shot.

The fact that the disks are rigidly coupled to the shaft and the wire vibrator suspended therebetween, provides a good mechanical and acoustical coupling to enhance the effect. It is further noted that no effect will be provided by this club if a ball or an object is not struck. Thus, during practice swings and so on, the club will feel as an ordinary club.

The disks 16 and 17 can be fabricated from any type of material, such as plastic, wood, metal and so on. The inclusion of the apparatus within the hollow confines of the club will effect the overall weight of the club slightly. All other shaft design as furnished by the manufacturer will not be effected in any particular way such as the vital flex points in the shaft. Thus a golfer may use a stiffer type shaft which will help him to be more accurate and still obtain all the advantages of being able to feel the club with the use of the apparatus according to this invention.

Figure 2:
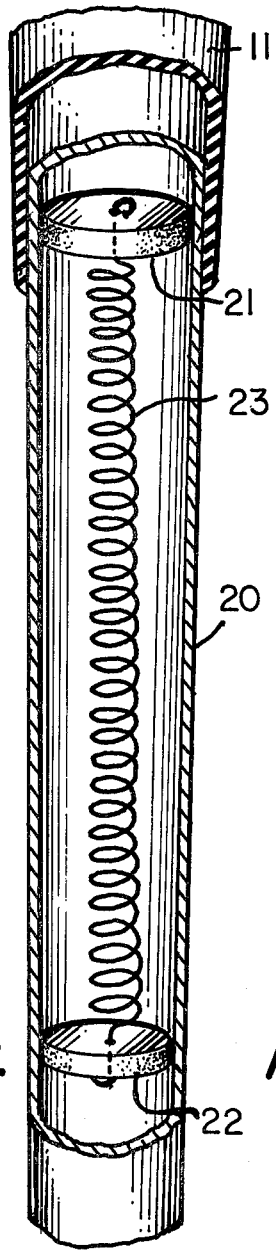
FIG. 2 is a partial cross sectional view of a hollow portion of a tubular shaft showing an alternate embodiment of this invention.

FIG. 2 shows a cross sectional view of a hollow portion of a golf club shaft 20 including two disks 21 and 22 rigidly secured within the hollow and a wire spring 23 secured between the disks. The spring 23 will also serve, upon impact, to provide the above described effect.

Figure 3:
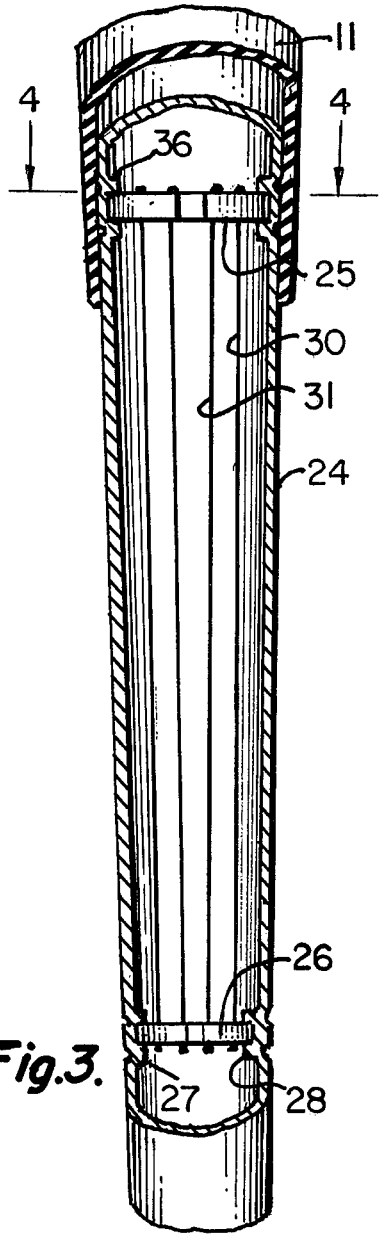
FIG. 3 is a partial cross sectional view of a hollow golf club shaft depicting still another alternate embodiment.

FIG. 3 is still another alternate embodiment of the invention. In FIG. 3, there is shown a cross sectional view 24 taken through a hollow section of a shaft. Two disks such as 25 and 26 are retained within the hollow portion of the shaft by means of projecting flange members as 27 and 28; which may be swaged into the shaft to accomodate the disks. The disks, once positioned on the flanges or projecting areas of the shaft, may then be glued in place, if desired. Suspended between these disks are a plurality of wires such as 30 and 31 which may be arranged in a circular or other configuration, wherein each wire will vibrate to cause a multiple effect, if desired.

Figure 4:
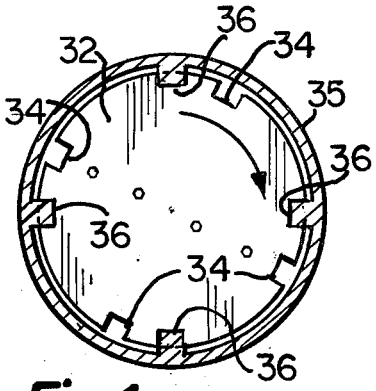
FIG. 4 is a top plan view depicting a disk and shaft arrangement according to this invention.

FIG. 4 shows a top view of a disk arrangement as depicted in FIG. 3; wherein a disk 32 (analgous to disks 25 and 26) has one or more peripheral apertures 34 located in a side surface. A cross section of a shaft 35 is shown with extending flange members such as 36. The flanges may be positioned as shown, for example, in FIG. 3. As can be easily seen, one would then insert the disk into the shaft and turn the disk in the direction of the arrow so that the apertures are then turned away from the flange and the disk sets in place.

There are, of course, numerous other ways to secure the disk to the shaft, but the apparatus shown in FIG. 4 is easy and simple to implement.

Figure 5:
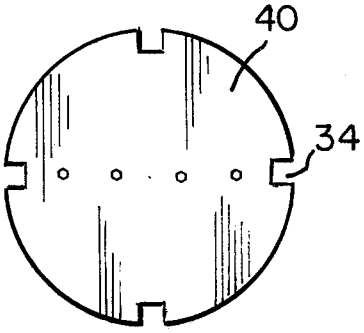
FIG. 5 is a perspective view of a particular disk as depicted in FIG. 4.

FIG. 5 is a perspective view of a disk 40; which may be used in conjunction with the mechanical structure depicted in FIGS. 3 and 4.

It is, of course, understood that there are numerous ways to implement the apparatus depicted above as by using different shaped disks, different means of coupling the disk within the hollow of the shaft, different techniques of coupling wires or the vibrating members to the disks and so on.

As indicated in FIG. 1, a weight 20 may also be emplaced to further effect the frequency intensity of vibration and may be spaced anywhere along the length of the wire or relatively one-half way between the disks 16 and 17, as shown in the figure.

Also, as depicted in FIG. 1, the disks 16 and 17 can be moved upwards into the handle portion of the club wherein the disk 16 may only be 2 inches from the top of the club and the disk 17 would extend downwards therefrom.

In summation, it is the main purpose of this invention to provide a golf club which can be used to play the game of golf while providing a user with a vibratory sensation related to his swing upon impact and only upon impact with a golf ball. The apparatus can be incorporated within the club during the manufacturing process or may be added to existing golf clubs by removal of the handle and insertion of the disks as described.

The claims appended hereto determine the scope of the invention described above.

I claim:

1. A golf club of the type comprising a golf club head, a tubular shaft having at least a hollow portion, said shaft coupled to said head at one end and handle means located on said shaft at said other end, in combination therewith of apparatus for providing a vibratory effect when said club head strikes a golf ball, comprising:

(a) first and second disk members rigidly secured within said hollow of said shaft and positioned one above the other at a distance along the length of said shaft, and (b) a flexible vibratory member coupled between said first and second disk members and located within said hollow relatively central thereto, said member adapted to vibrate when said club head strikes said ball due to the impact of said club head with said ball to impart a vibratory feel to the hands of a user of said club during said impact, said member comprising at least one wire coupled between said first and second disk members, and a weight member secured to said wire and located relatively at an equal distance from said first and second disks.

2. The golf club according to claim 1 wherein said first and second disk members are relatively circular in shape and relatively congruent with the cross section of said hollow of said shaft, and an epoxy bond rigidly securing said members one above the other.

3. The golf club according to claim 1 wherein said disks each have at least one peripheral aperture on a surface thereof, said shaft including at least first and second projecting flanges located in said hollow portion of said shaft and projecting inwardly, said flanges spaced apart according to said distance, wherein said aperture of said disks is larger than said flanges to permit insertion thereof within said hollow.

4. The golf club according to claim 1 wherein said weight member is fabricated from a metal.

5. The golf club according to claim 1 wherein at least one of said disks includes a central aperture in a surface thereof adapted to accomodate one end of said vibratory member to secure the same to said disk.

* * * * *